United States Patent [19]

Tobin

[11] 4,229,723

[45] Oct. 21, 1980

[54] DIAPHRAGM HAVING A PATTERN OF REDUCED THICKNESS IN A HIGH VOLTAGE, CIRCUIT-INTERRUPTING DEVICE

[75] Inventor: Thomas J. Tobin, Northbrook, Ill.

[73] Assignee: S&C Electric Company, Chicago, Ill.

[21] Appl. No.: 26,842

[22] Filed: Apr. 4, 1979

[51] Int. Cl.[3] ..... H01H 33/915

[52] U.S. Cl. ..... 337/275; 200/144 R; 200/148 R; 337/282

[58] Field of Search ..... 337/274, 275, 280, 282; 200/145

[56] References Cited

U.S. PATENT DOCUMENTS

| | | | |
|---|---|---|---|
| 4,161,711 | 7/1979 | Meister | 337/275 |
| 4,183,005 | 1/1980 | Meister et al. | 337/275 |

*Primary Examiner*—William H. Beha, Jr.
*Attorney, Agent, or Firm*—John D. Kaufmann

[57] ABSTRACT

An improved circuit-interrupting device of the type which includes an arcing rod which is moved away from a stationary contact in response to an overcurrent through the device. The device includes a container of pressurized dielectric fluid having a port from which the fluid is directed at an elongating arc formed between the moving arcing rod and the stationary contact. The device also includes a diaphragm normally contacted by the arcing rod which normally closes the port and restrains arcing rod movement. The improvement includes a pattern of reduced thickness in the diaphragm about the point of contact between the diaphragm and the arcing rod. The pattern may be circular or star-shaped and may be produced by pressing, dieing, stamping, scoring, forming, etching, or coating. Depending on the specific construction of the device, the diaphragm either fuses or melts along the pattern or is ruptured or torn by arcing rod movement following an overcurrent through the device. The pattern ensures that a large opening is formed in the diaphragm to permit the escape from the container of sufficient dielectric fluid to ensure extinguishment of the arc.

24 Claims, 5 Drawing Figures

10
16
43
41
44
42
36
34
28
48
32
45
3,4
24
20
40
18
47
46
30
22
14
49
26
12

53
55
54
82
56
84
86
62
90
80
60
88
68
72
64
66
50
70
58
74
51
52

DIAPHRAGM HAVING A PATTERN OF REDUCED THICKNESS IN A HIGH VOLTAGE, CIRCUIT-INTERRUPTING DEVICE

BACKGROUND OF THE INVENTION

1. Field of the Invention

The present invention relates to a circuit-interrupting device and more particularly to a high-voltage circuit-interrupting device which utilizes a moving contact, a source of pressurized-dielectric gas, and a stored energy source for moving the movable contact.

2. Brief Description of the Prior Art

Various types of circuit-interrupting devices are well known. One species of circuit-interrupting devices includes fuses or fuse-like devices, subspecies of which are those circuit-interrupting devices disclosed in the following commonly assigned, U.S. Patent Applications, all filed May 24, 1978: Ser. No. 909,144 and Ser. No. 909,145, now U.S. Pat. No. 4,183,005, in the names of O. Meister and T. J. Tobin; and Ser. No. 909,146, now U.S. Pat. No. 4,161,711, in the name of O. Meister. All three of these patent applications are specifically incorporated by reference hereinto.

The above-noted subspecies includes circuit-interrupting devices of two different types. The first type includes an arcing rod which is movable away from a stationary contact following the fusing of a fusible element due to an overcurrent through the device. A pressurized dielectric fluid is directed from the port of a container at an elongating arc which is formed between the moving arcing rod and the contact. A diaphragm, normally contacted by the arcing rod, normally closes the port and prevents a stored energy device, such as a spring, from moving the arcing rod. The diaphragm itself is also fusible. The fusible element is connected to the arcing rod in such a manner that it normally shunts the majority of current through the device away from the fusible diaphragm. Upon the occurrence of an overcurrent through the device, the fusible element fuses or melts which causes all current to now flow through the fusible diaphragm. Ultimately, the fusible diaphragm melts or fuses, releasing the arcing rod to the action of the spring and opening the port to permit the dielectric fluid to be directed at the elongating arc formed between the arcing rod and the stationary contact.

The second type of interrupting device within the subspecies disclosed in the above-noted patent applications includes a movable contact or arcing rod which is moved away from a stationary contact following an overcurrent through the device. Arcing rod movement is initiated by the action of an ignitable power cartridge on a piston-cylinder arrangement connected to the arcing rod. A quantity of pressurized dielectric fluid in a container is normally prevented from escaping through a port thereof by a rupturable or tearable diaphragm closing the port. Movement of the arcing rod by the power cartridge causes the arcing rod, which is connected to the diaphragm, to tear or rupture the diaphragm, thus forming an opening therein permitting the fluid to escape and to be directed at the elongating arc struck between the moving arcing rod and the contact.

In both types of devices it has been found prudent to ensure that the opening formed in the diaphragm has an appropriate shape and a sufficiently large size to ensure that the dielectric fluid escapes from the port in sufficient quantity and at a sufficient velocity to extinguish the arc.

Thus, the present invention comprises an improvement of the devices disclosed and claimed in the above-noted patent applications.

SUMMARY OF THE INVENTION

In its broadest form, the present invention relates to an improvement in circuit-interrupting devices of the type having a movable contact which moves away from a stationary contact following an overcurrent through the device. A pressurized dielectric fluid is directed from a port of a container at an elongating arc formed between the moving contact and the stationary contact. A diaphragm, normally contacted by the movable contact, normally closes the port and prevents movable contact movement. In the improved device, the diaphragm has a thin pattern, or a pattern of reduced thickness, therein, the pattern surrounding the point of contact between the diaphragm and the movable contact. The pattern may be substantially circular or star-shaped and may be produced by pressing, dieing, stamping, scoring, coining, or other forming operations, as well as by etching or coating. In one preferred embodiment, the thickness of the pattern decreases as its distance from the point of contact between the diaphragm and the movable contact increases.

The present invention may be used in a first type of circuit-interrupting device wherein the diaphragm is fusible and a stored energy mechanism biases the movable contact for movement away from the stationary contact. In this type of device, a fusible element is connected to the movable contact so as to normally shunt a majority of the current through the device away from the fusible diaphragm. When the invention is used with this type of device, the thin cross-section pattern is substantially the only portion of the diaphragm which fuses or melts following fusing or melting of the fusible element. Thus, an opening is formed in the diaphragm conforming to the pattern and the movable contact is released to the action of the stored energy mechanism.

The invention may also be used in a second type of circuit-interrupting device wherein the seal is rupturable or tearable when a stored energy mechanism such as a power cartridge forcefully moves the movable contact. Movement of the movable contact is sufficiently forceful to rupture or tear the diaphragm along the pattern to form an opening in the diaphragm conforming thereto.

DETAILED DESCRIPTION

The present invention is usable with various types of circuit-interrupting devices. It is especially useful in those circuit-interrupting devices disclosed and claimed in the above commonly assigned U.S. patent applications, hereinafter referred to as the 909,144, 909,145, and 909,146 applications, respectively.

Figure 1:
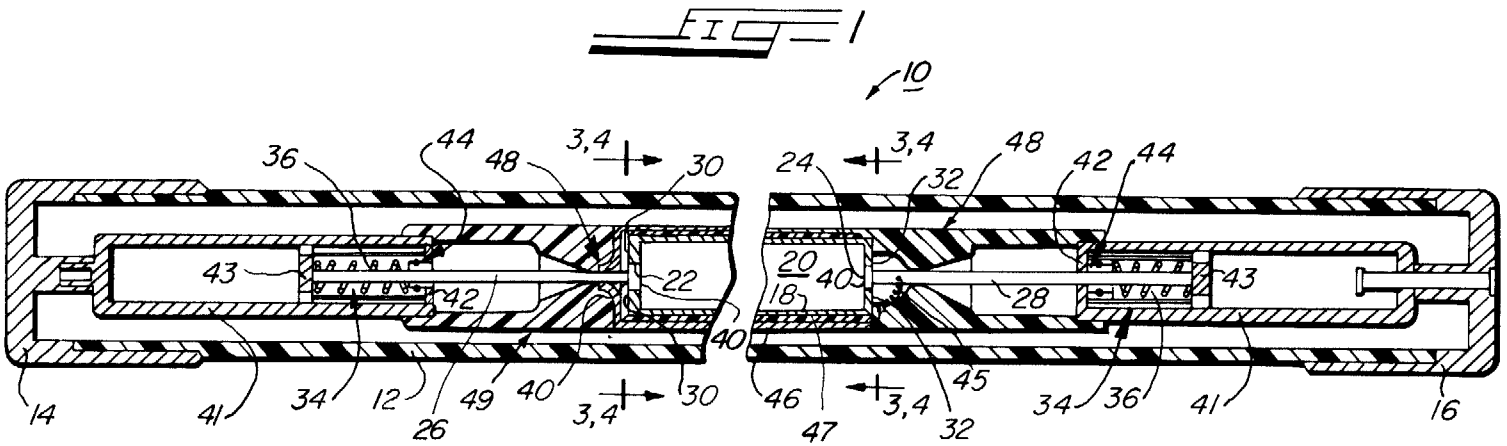
FIG. 1 is a side, partially sectioned view of one type of improved circuit-interrupting device in accordance with the principles of the present invention.
Figure 2:
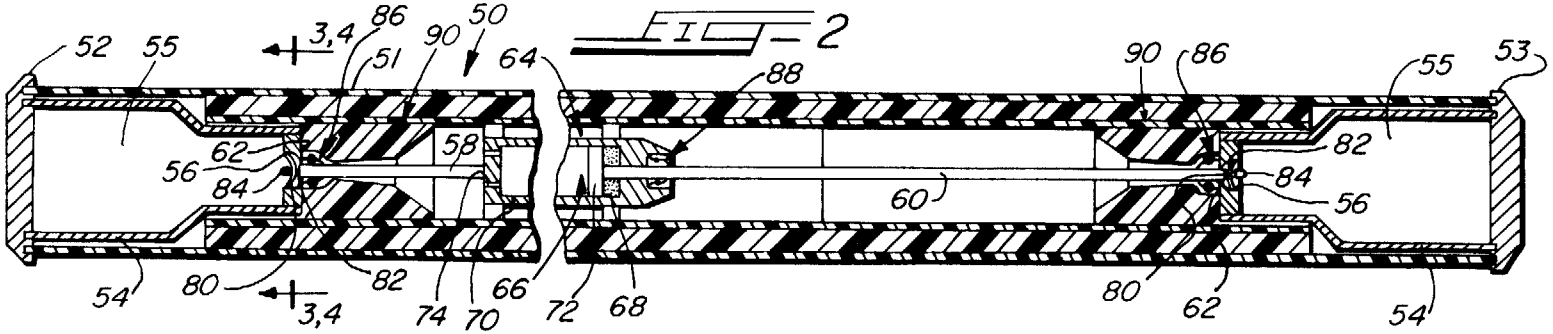
FIG. 2 is a side, partially sectioned view of another type of improved circuit-interrupting device in accordance with the principles of the present invention.

In FIG. 1, there is shown the type of circuit-interrupting device 10 disclosed and claimed in the 909,144 application. A second type of interrupting device 50, depicted generally in FIG. 2, is the type shown in the 909,145 application. The present invention is useful with both devices 10 and 50, and with the circuit-interrupting device disclosed and claimed in the 909,146 application, as well as with other types of circuit-interrupting devices, as will be clear to those skilled in the art.

Referring first to FIG. 1, the interrupting device 10 may be seen to include an elongated, insulative housing 12, on opposed ends of which are mounted circuit-connectable metallic end ferrules 14 and 16. The housing 12 encloses a centrally-located container 18 charged with a quantity of pressurized, dielectric fluid, such as sulphur hexafluoride ($SF_6$) 20. The container 18 has a pair of opposed ports 22 and 24 formed therein. Respective movable contacts or arcing rods 26 and 28 are normally positioned adjacent the ports 22 and 24. The arcing rods 26 and 28 comprise elongated conductive members which are movable generally along, and parallel to, the major axis of the housing 12. Portions 30 and 32 of the container 18 immediately surrounding the respective ports 22 and 24 may constitute stationary contacts. For this reason, as will be made clear shortly, the container 18 is made of a conductive material. Alternately, a separate stationary contact structure (not shown) may be provided near the ports 22 and 24.

The arcing rods 26 and 28 are both respectively biased away from the stationary contacts 30 and 32 by similar stored energy mechanisms 34 which may include similar compressed springs 36. Both ports 22 and 24 are normally closed by similar fusible diaphragms 40 which normally cover the ports 22 and 24 and which are connected as by brazing, welding, or the like to the arcing rods 26 and 28. As long as the fusible diaphragms 40 remain intact, not only are the ports 22 and 24 sealed to prevent the escape of the $SF_6$ 20 from the container 18, but also movement of the arcing rods 26 and 28 by the compressed springs 36 is prevented. The diaphragms 40 are preferably made of a fusible material such as Nichrome or stainless steel which will melt or fuse upon the passage therethrough of sufficient current.

The stored energy mechanisms 34 include similar conductive cylindrical members 41 which contain the springs 36. The mechanisms 34 also each include a stationary member or wall portion 42 and a movable reaction member 43 attached to an end of the arcing rods 26 and 28. The compressed springs 36 act between the stationary member 42 and the reaction member 43 to bias the arcing rods 26 and 28 for movement away from the stationary contacts 30 and 32. The conductive cylindrical members 41 are respectively attached to one end ferrule 14 or 16 by any convenient facility and are also in constant, sliding electrical engagement with their respective arcing rods 26 and 28 via tulip contact assemblies 44 or the like.

One end of a fusible element 45 is connected to the arcing rod 28 near the right end of the container 18. The other end of the fusible element 45 is connected to one end of a conductive member 46 which runs along the container 18 but is electrically insulated therefrom by an insulative member 47. The other end of the conductive member 46 is electrically connected to a tulip contact assembly 48 which slidingly engages the forwardmost end of the arcing rod 26 immediately adjacent the port 22 and which may act as a stationary contact for the arcing rod 26. The fusible element 45 is so selected that it will fuse, melt, or vaporize upon the passage through the device 10 of a predetermined overcurrent.

Surrounding each port 22 and 24 and also surrounding the forward ends of the arcing rods 26 and 28 are respective nozzle assemblies 49.

The normal conductive path through the device 10 going from left to right comprises the end ferrule 14, the left-hand conductive cylindrical member 41, the left-hand tulip contact assembly 44, the arcing rod 26, the tulip contact assembly 48, the conductive member 46, the fusible element 45, the arcing rod 28, the right-hand tulip contact assembly 44, the right-hand conductive cylindrical member 41, and the end ferrule 16. Only a very small amount of current passes through the diaphragms 40 and the container 18 under normal conditions because the resistance of a first electrical path, which includes the arcing rods 26 and 28, the diaphragms 40, and the container 18, is substantially higher than a second electrical path (the normal path), which includes the arcing rods 26 and 28, the fusible element 45, and the conductive member 46. As will be seen hereinafter, the higher resistance of the first electrical path may be in part ensured by the present invention. Due to the difference in electrical resistance between the two paths, it may be said that the fusible element 45 ensures that most of the current through the device 10 is, under normal conditions, shunted away from the diaphragms 40.

Should an overcurrent pass through the device 10, the fusible element 45 fuses, melts, or evaporates. When the fusible element 45 is no longer intact, current flow, rather than being shunted by such fusible element 45, now flows from the arcing rod 28 directly through the right-hand diaphragm 40, the container 18, and the left-hand diaphragm 40, and from there to the arcing rod 26. As a consequence of this current flow, all or a portion of the fusible diaphragms 40 melt, fuse, or evaporate. Once the diaphragms 40 are no longer intact, the ports 22 and 24 are opened to permit the passage therethrough of the dielectric fluid 20 from the container 18. Simultaneously with the initiation of such fluid flow, the springs 36 initiate movement of the arcing rods 26 and 28 away from their respective stationary contacts 30 (or 48) and 32. Such arcing rod movement immediately follows or results in the formation of an arc between the ends of the arcing rods 26 and 28 and their respective stationary terminals 30 (or 48) and 32. Continued movement of the arcing rods 26 and 28 by the springs 36 elongates the arc. Fluid flowing from the ports 22 and 24 flows out of the nozzle assemblies 49 reaching sonic or near sonic velocity therein and is directed at the elongating arc as the arcing rods 26 and 28 continue to move. The combined action of such elongation and the cooling, turbulent, and deionizing effects of the escaping fluid ultimately result in the extinguishment of the arc and interruption of the circuit at some subsequent current zero.

Thus, in the device of FIG. 1, the diaphragms 40 are called upon to melt, fuse, or evaporate due to the passage of current therethrough. Such current passage is normally prevented by the shunting effect of the fusible element 45. It should be noted that the device 10 of FIG. 1 is a two-gap interrupter; in the 909,144 application, there is also shown a single-gap version of the device 10. The main principle of operation in the one- and two-gap versions is essentially the same. Namely, the fusible element 45 shunts current from the fusible diaphragms 40 during normal conditions.

Referring now to FIG. 2, there is shown the type of device 50 which is depicted and claimed in the 909,145 application. Similar to the device depicted in FIG. 1, the interrupting device 50 may have either a one-gap or a two-gap configuration. FIG. 2 generally depicts a two-gap configuration, it being understood that the one-gap configuration may also utilize the present invention.

The interrupting device 50 includes an elongated insulated housing 51 carrying on opposed ends thereof circuit connectable end ferrules 52 and 53. At either end of the insulated housing 51 and contained therewithin are similar conductive containers 54 which each contain a quantity of pressurized, dielectric fluid 55 such as $SF_6$ and which are respectively electrically connected to the end ferrules 52 and 53. Defined at the end of each container 54 and facing inwardly are similar ports 56 from which the fluid 55 may issue. Movable arcing rods 58 and 60 are mounted for movement within the housing 51 generally along and parallel to the major axis thereof. Although the arcing rods 58 and 60 may have different lengths, they are similarly configured and are each made of a conductive material.

An end of each arcing rod 58 and 60 is normally positioned adjacent a respective port 56 and also immediately adjacent a portion 62 of the container 54 immediately surrounding the ports 56 which portions 62 may serve as stationary contacts. Separate stationary contacts may be used if desired. A stored energy mechanism 64 which includes a piston-cylinder arrangement 66 and a power cartridge 68 is associated with the arcing rods 58 and 60 for selective movement thereof. A movable cylinder 70 of the piston-cylinder arrangement 66 is attached to one end of the arcing rod 58. A movable piston 72 of the piston-cylinder arrangement 66 which is mounted for sliding, sealing movement within the cylinder 70 is connected to one end of the arcing rod 60. The power cartridge 68 is connected by wires or conductors (not shown) to an overcurrent sensing and triggering module (not shown) which may be contained within the device 50 or which may be external thereto. The module transmits an electric signal to the power cartridge 69 for ignition thereof when an overcurrent through the device 50 occurs. Ignition of the power cartridge 68 expands the volume formerly occupied thereby to relatively move the piston 72 and the cylinder 70. Specifically, relative movement of the cylinder 70 and the piston 72 takes the form of leftward movement by the piston 72 and rightward movement by the cylinder 70. Leftward movement of the piston 72 moves the arcing rod 60 leftwardly from its associated stationary contact 62. Rightward movement of the cylinder 70 is accompanied by rightward movement of the arcing rod 58 away from its associated stationary contact 62. The cylinder 70 may be vented as shown at 74 to prevent resistance to this relative movement of the cylinder 70 and the piston 72.

The ports 56 are normally closed by similar rupturable or tearable diaphragms 80. The normal presence of the diaphragms 80 prevents the escape of the fluid 55 from the ports 56. Also, the arcing rods 58 and 60 are respectively attached to their associated diaphragms 80 so that the diaphragms 80 normally restrain movement thereof. As disclosed in the 909,145 and 909,146 applications, the arcing rods 58 and 60 are mechanically attached to the diaphragms 80 and may pass therethrough. Specifically, a necked down portion 82 which passes through and is sealed to the diaphragms 80 may bear at its end a cutting tip 84 or the like. For purposes of the present invention, the cutting tip 84 may or may not be present as will be seen shortly.

Both containers 54 are conductive and surrounding the ports 56 thereof are tulip contact assemblies 86, which are in sliding electrical contact with the arcing rods 58 and 60 and which may serve as stationary contacts. The piston 72 and the cylinder 70 are also conductive so that there is continuous sliding electrical engagement therebetween. To ensure a continuous electrical circuit between the arcing rods 58 and 60, the right end of the cylinder 70 may be provided with a tulip contact arrangement 88 which continuously, slidingly engages the arcing rod 60.

Surrounding the ports 56 and initially surrounding the forward ends of the arcing rods 58 and 60 are respective nozzle assemblies 90, which are similar in structure and function to the nozzle assemblies 48 used with the interrupting device 10 of FIG. 1.

Under normal conditions, the interrupting device 50 is connected into a circuit via the end ferrules 52 and 53. Current through the interrupting device 50 flows through a normal current path comprising, from left to right, the end ferrule 52, the left-hand container 54, the left-hand tulip contact assembly 86, the arcing rod 58, the cylinder 70, the tulip contact arrangement 88, the arcing rod 60, the right-hand tulip contact assembly 86, the right-hand container 54, and the end ferrule 53. Should an overcurrent through the device 50 occur, the sensing and triggering module (not shown) transmits an ignition signal to the power cartridge 68 causing the above-described movement of the arcing rods 58 and 60. During their movement, the arcing rods 58 and 60 remain in electrical contact via the tulip contact arrangement 88. Such movement of the arcing rods 58 and 60, due to the mechanical coupling between them and their respective diaphragms 80, effects rupturing or tearing of the diaphragms 80 by the cutting tips 84, thus forming an opening therein and permitting the fluid 55 within the containers 54 to exit through the ports 56. Fluid 55 issuing from the ports 56 is directed by the nozzle assemblies 90 at the moving arcing rods 58 and 60 at sonic or near sonic velocity. As the arcing rods 58 and 60 break electrical contact with their respective tulip contact assemblies 86, arcs are formed between them and either their respective tulip contact assemblies 86 or the respective portions 62 of the containers 54. As the arcing rods 58 and 60 continue their movement, the arcs are elongated. Moreover, the fluid 55 now flowing at sonic or near sonic velocity from the nozzle assemblies 90 is directed at the arcs. The combined effect of arc elongation and the turbulent, cooling, and deionizing action of the fluid 55 ultimately results in extinguishment of the arcs at some subsequent current zero.

As noted earlier, the arcing rods 58 and 60 as disclosed in the 909,145 application may have cutting tips 84 on the ends thereof. Such cutting tips 84 are disclosed in that patent application as serving the function of tearing or rupturing the diaphragms 80. As will appear hereinafter, such cutting tips 84 need not be used when the present invention is used with the device 50.

An interrupting device similar to the device 50 is disclosed in the 909,146 application. In the device of the last-named application, a piston-cylinder is contained within a dielectric fluid-charged container to not only effect movement of one or more arcing rods, but also to force substantially all of the fluid from the container. The arcing rods in the last-named application, however, similar to the arcing rods in the device 50, also rupture or tear a diaphragm normally closing a port in the container. Accordingly, the present invention is usable also with the device of the 909,146 application even though the circuit interrupting device thereof is not described in detail herein.

In the first type of interrupting device 10, depicted in FIG. 1, the diaphragms 40 are at some point during the operation of the device 10 expected to fuse or melt. Such fusing or melting of the diaphragms 40, as described above, occurs when current is suddenly directed through the diaphragms 40 due to the fusing of the fusible element 45. Fusing or melting of the diaphragms 40 both opens the ports 22 and 24 and releases the arcing rods 26 and 28 to the action of the springs 36.

In the second type of interrupting device 50, shown in FIG. 2, and in the device of the 909,146 application, the diaphragms 80 are expected to be torn or ruptured by the forceful movement of the arcing rods 58 and 60. Such arcing rod movement is initiated by the action of the power cartridge 68 on the piston-cylinder arrangement 66.

Regardless of the type of interrupting device 10, 50, etc., the opening formed in the diaphragms 40 and 80 thereof must be of a sufficiently large size to permit the escape of sufficient fluid 20 and 55 from the containers 18 or 54 so that extinguishment of the arc formed between the arcing rods 26,28 or 58,60 and the stationary contacts 30,23 or 62,86 is ensured.

Figure 3:
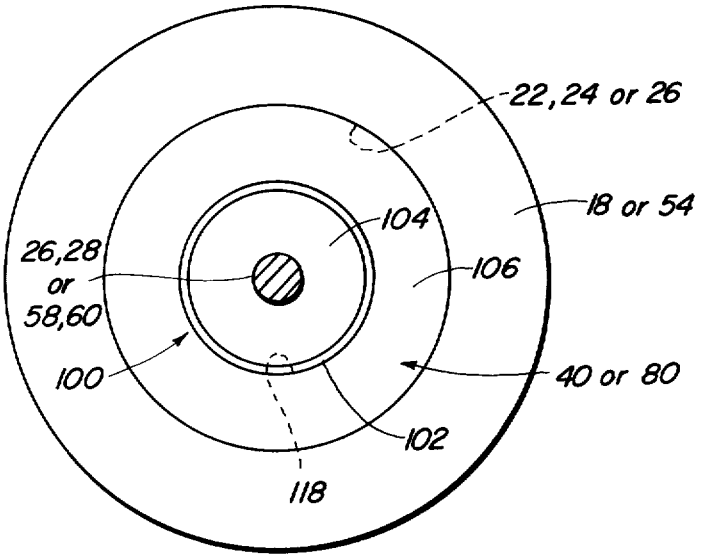
FIGS. 3, 4, and 5 are alternative embodiments of the present invention, all being taken along lines 3,4—3,4 in FIGS. 1 and 2.
Figure 4:
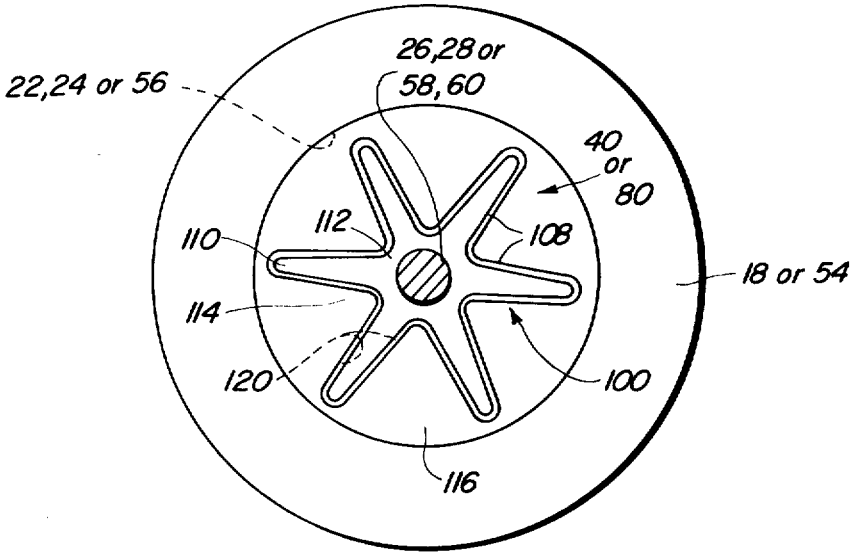

Referring now to FIGS. 3 and 4, there are shown two alternative embodiments of diaphragms 40 or 80 usable with the interrupting devices 10 or 50 of FIGS. 1 or 2, as well as with other devices such as those shown in the 909,146 application. Generally speaking, the invention relates to the formation of a thin pattern 100 in the diaphragms 40 or 80. The pattern 100 is thinner than the remainder of the diaphragm 40 or 80. The pattern 100 may surround or be located about, and be coaxial with, the point of normal contact between the arcing rods 26,28 or 58,60 and the diaphragms 40 or 80, although such surrounding or coaxial relationships are not necessary. In the case of the circuit interrupting device 10 of the first type shown in FIG. 1, the pattern 100 ensures the fusing or melting of the diaphragms 40 substantially only in the area of the pattern 100. Such fusing or melting of the diaphragms 40 in the area of the pattern 100 is predictable and similar from diaphragm-to-diphragm and leaves an opening in the diaphragms 40 of sufficiently large size to permit the escape from the container 18 of sufficient dielectric fluid 20 to extinguish the arcs. A similar result is achieved when the pattern 100 is formed in the diaphragms 80 of the device 50 of FIG. 2. Specifically, the pattern 100 ensures the tearing or rupturing of the diaphragms 80 along the pattern 100 in a predictable manner to permit sufficient fluid escape to extinguish the arcs.

In FIG. 3, the pattern 100 is shown as having a circular configuration 102. The circular pattern 102 divides the diaphragms 40 or 80 into inner and outer areas 104 and 106, the pattern 102 and the areas 104 and 106 being preferably coaxial with the arcing rods 26,28 or 58,60. Where the circular configuration 102 is used, it is preferred that the thickness of the pattern 102 be substantially constant, unless the circular pattern 102 is not coaxial with the arcing rods 26,28 as explained below.

In FIG. 4, the pattern 100 is shown to have a star-shaped configuration 108. The star-shaped pattern 108 may have any convenient number of legs 110 (six being shown) defining an inner area 112 of the diaphragms 40,80 enclosed by the pattern 108. The pattern 108 defines petal-like portions 114 in an outer area 116 of the diaphragms 40 or 80 outside the pattern 108 and generally between the legs 110. Where the star-shaped pattern 108 is used, it may have a constant thickness or a thickness which varies inversly as the radial distance from the arcing rods 26,28 or 58,60.

The pattern 100, whether circular 102 or star-sahped 108, may be formed in the diaphragms 40 or 80 by any convenient method including pressing, dieing, stamping, scoring, or forming.

Either the circular pattern 102 or the star-shaped pattern 108 may be present in the diaphragms 40 of the first type of interrupting device 10 depicted in FIG. 1. In the device 10, the diaphragm 40 in which the pattern 100 is formed is fusible. As described earlier, when the fusible element 45 fuses or melts due to an overcurrent, all or a portion of the diaphragm 40 subsequently melts or fuses because of the elimination of the normal current shunt path therearound. Because the decreased thickness of the thin patterns 102 or 108 has a higher electrical resistance than the remainder of the diaphragm 40, as current flows through the diaphragm 40 from the arcing rod 26 or 28, the diaphragm 40 melts or fuses substantially only along the pattern 102 or 108. Subsequent movement of the arcing rod 26 or 28 carries with it the inner area 104 or 112, consequently leaving a large, well-defined opening (indicated in phantom at 118 and 120) in the diaphragm 40 conforming to the pattern 102 or 108 and through which the dielectric fluid 20 or 55 may escape. In the case of the star-shaped pattern 108, not only does such melting or fusing along the pattern 108 occur, but further the pressurized fluid 20 or 55 within the container 18 or 54 tends to deform outwardly the petal-like portions 114 as it escapes, thus further increasing the size of the opening 120 formed through the diaphragm 40. Further, when the star-shaped pattern 108 (or a non-coaxial pattern 102) is used in the device 10, it may be desirable to vary the cross-sectional thickness thereof so that the pattern 108 is thinner at points farther away from the normal point of contact between the arcing rods 26,28 or 58,60 and the diaphragm 40. This thickness variation is preferably effected so that the current density in the pattern 102 or 108 after the fusible element 45 fuses is substantially the same in all portions thereof. Rendering the current density the same in all portions of the pattern 102 or 108 predictably produces (from diaphragm to diaphragm) a large opening 120 in the diaphragm 40 due to the simultaneous fusing or melting of all parts of the pattern 108.

In the device 10 of FIG. 1, the patterns 102 or 108 may be relied on, in part, to increase the electrical resistance of the first current path which normally includes the arcing rod 26 or 28 and the diaphragm 40 with respect to the electrical resistance of the second current path, which normally includes the arcing rod 26 or 28 and the fusible element 45. This, of course, further ensures that in normal operation the majority of the current through the device 10 flows through the arcing rods 26 and 28 and the fusible element 45 and not through the diaphragm 40. The desirable higher resistance of the first current path may be further increased, to ensure that the diaphragm 40 melts or fuses along the patterns 102 or 108 only after the fusible element 45 has fused or melted, by making the diaphragm 40 of a high resistivity material and/or by rendering the normal point of contact between the arcing rod 26 or 28 and the diaphragm 40 a high resistance joint. A typical high resistivity material for the diaphragm 40 is stainless steel. Preferably, the first current path has a resistance at least about $10^2$ times greater than that of the second path.

Where the patterns 102 or 108 are formed in the diaphragm 80 of the interrupting device 50, rupturing or tearing thereof due to movement of the arcing rod 58 or 60 in predictable and yields a sufficiently large opening therein to ensure the escape of sufficient dielectric fluid 55 to extinguish the arc. Such tearing or rupturing of the diaphragm 80 is enhanced by the decreased thickness in the patterns 102 or 108. Where the star-shaped pattern 108 is utilized, tearing or rupturing of the diaphragm 80 along the pattern 108 subsequently permits the high pressure fluid 55 within the container 54 to deform the petal-like portions 114 outwardly, thus even further increasing the size of the opening 120 through the diaphragm 80. The cutting tips 84 need not necessarily be used when the diaphragms 80 have the patterns 102 or 108 formed therein.

Figure 5:
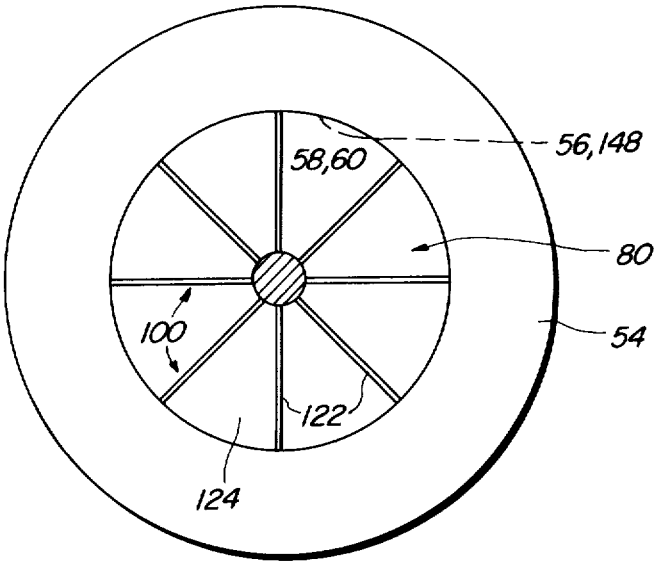

FIG. 5 depicts yet another embodiment of the present invention which is a variant of FIG. 4 and is intended for use with the device 50 of FIG. 2 or with the device of the 909,146 application. The pattern 100 of FIG. 5 comprises a plurality of radial lines 122 formed in, and thinner than the rest of, the diaphragm 80. The lines 22 may extend from the junction of the diaphragm 80 and the container 54 (i.e., from the port 56) to the point of connection of the arcing rod 58,60 to the diaphragm 80. The lines 122 define areas 124 therebetween similar to the petal-like portions 114 of the pattern 108 in FIG. 4.

When the arcing rod 58,60 is moved away from the container 54, the inner area of the diaphragm 80 is torn or ripped along the lines 122. The pressure of the fluid 55 forces the areas 124 outwardly, completing the tearing of the diaphragm 80 along the lines 122. Thus, an opening 148 is formed which is as large as the port 56 and little, if any, of the diaphragm 80 is carried by the arcing rod 58,60 through the nozzle 90.

I claim:

1. An improved circuit-interrupting device of the type wherein a movable contact is moved away from a stationary contact in response to an overcurrent through the device and pressurized dielectric fluid is directed from a port of a container at an elongating arc formed between the contacts; the device having a diaphragm normally contacted by the movable contact for normally closing the port and for preventing movable contact movement; wherein the improvement comprises:

a pattern formed in the diaphragm about the point of contact between the diaphragm and the movable contact, the pattern being thinner than the remainder of the diaphragm.

2. The device of claim 1, wherein the pattern is substantially circular.

3. The device of claim 1, wherein the pattern is non-circular.

4. The device of claim 3, wherein the pattern is star-shaped.

5. The device of claim 3, wherein the pattern comprises a plurality of radial lines extending away from the point of contact between the diaphragm and the movable contact.

6. The device of claim 2, 3, or 4, wherein the thickness of the pattern decreases as the distance of the pattern from the point of contact between the diaphragm and the movable contact increases.

7. The device of claim 1, wherein the diaphragm is fusible, a stored energy means biases the movable contact for movement, and a fusible element is connected to the movable contact so as to normally shunt the majority of the current through the device away from the fusible diaphragm, substantially only the thin pattern fusing following fusing of the fusible element by the overcurrent to form an opening in the diaphragm conforming to the pattern and to release the arcing rod to the action of the biasing means.

8. The device of claim 7, wherein the pattern is substantially circular.

9. The device of claim 7, wherein the pattern is non-circular.

10. The device of claim 9, wherein the pattern is star-shaped.

11. The device of claim 8, 9, or 10, wherein the thickness of the pattern decreases as the distance of the pattern from the point of contact between the diaphragm and the movable contact increases.

12. The device of claim 7, wherein the pattern is sufficiently thin to ensure that the electrical resistance of a first current path, which normally includes the movable contact and the diaphragm, is substantially higher than the electrical resistance of a second current path, which includes the movable contact and the fusible element.

13. The device of claim 12, wherein the diaphragm is a high resistivity metal.

14. The device of claim 13, wherein the metal is stainless steel.

15. The device of claim 12, wherein the point of contact between the diaphragm and the movable contact is a high electrical resistance joint.

16. The device of claim 12, wherein the electrical resistance of the first path is at least about $10^2$ times higher than the electrical resistance of the second path.

17. The device of claim 1, wherein the diaphragm is tearable, and a stored energy means forcibly moves the movable contact, movement of the movable contact tearing the diaphragm along the pattern to form an opening therein conforming to the pattern.

18. The device of claim 17, wherein the point of contact between the movable contact and the diaphragm is a mechanical connection therebetween.

19. The device of claim 17, wherein the pattern is substantially circular.

20. The device of claim 17, wherein the pattern is non-circular.

21. The device of claim 20, wherein the pattern is star-shaped.

22. The device of claim 20, wherein the pattern comprises a plurality of radial lines extending away from the point of contact between the diaphragm and the movable contact.

23. The device of claims 19, 20, 21 or 22 wherein the thickness of the pattern varies as the distance of the pattern from the point of contact between the diaphragm and the movable contact increases so that the current density is the same in all portions of the pattern.

24. An improved circuit-interrupting device of the type wherein an arcing rod is moved away from a stationary contact following an overcurrent through the device and pressurized dielectric fluid is directed from a port of a container at an elongating arc formed between the moving arcing rod and the contact; the device having a diaphragm normally contacted by the arcing rod for normally closing the port and for restraining arcing rod movement; wherein the improvement comprises:

the diaphragm having a variable cross section so dimensioned that the current density is the same in all portions thereof.

* * * * *